US008872719B2

(12) United States Patent
Warnick

(10) Patent No.: US 8,872,719 B2
(45) Date of Patent: Oct. 28, 2014

(54) APPARATUS, SYSTEM, AND METHOD FOR INTEGRATED MODULAR PHASED ARRAY TILE CONFIGURATION

(75) Inventor: Karl F. Warnick, Spanish Fork, UT (US)

(73) Assignee: Linear Signal, Inc., Spanish Fork, UT (US)

( * ) Notice: Subject to any disclaimer, the term of this patent is extended or adjusted under 35 U.S.C. 154(b) by 839 days.

(21) Appl. No.: 12/942,879

(22) Filed: Nov. 9, 2010

(65) Prior Publication Data

US 2011/0109507 A1 May 12, 2011

Related U.S. Application Data

(60) Provisional application No. 61/259,608, filed on Nov. 9, 2009.

(51) Int. Cl.
*H01Q 21/00* (2006.01)

(52) U.S. Cl.
USPC ..... 343/853

(58) Field of Classification Search
USPC ..... 343/853
See application file for complete search history.

(56) References Cited

U.S. PATENT DOCUMENTS

| | | | | |
|---|---|---|---|---|
| 4,079,268 | A * | 3/1978 | Fletcher et al. | 307/151 |
| 4,166,274 | A | 8/1979 | Reudink et al. | 342/376 |
| 5,019,793 | A | 5/1991 | McNab | 333/156 |
| 5,059,982 | A | 10/1991 | Bacrania et al. | |
| 5,065,123 | A | 11/1991 | Heckaman et al. | |
| 5,070,451 | A | 12/1991 | Moore et al. | |
| 5,096,670 | A | 3/1992 | Harris et al. | |
| 5,113,361 | A | 5/1992 | Damerow et al. | |
| 5,131,272 | A | 7/1992 | Minei et al. | |
| 5,138,319 | A | 8/1992 | Tesch | |
| 5,150,120 | A | 9/1992 | Yunus | |
| 5,164,627 | A | 11/1992 | Popek | |
| 5,173,790 | A | 12/1992 | Montgomery | |
| 5,181,207 | A | 1/1993 | Chapman | |
| 5,206,600 | A | 4/1993 | Moehlmann | |
| 5,216,435 | A * | 6/1993 | Hirata et al. | 343/853 |
| 5,218,373 | A | 6/1993 | Heckaman et al. | |
| 5,225,823 | A | 7/1993 | Kanaly | |
| 5,258,939 | A | 11/1993 | Johnstone et al. | |
| 5,276,633 | A | 1/1994 | Fox et al. | |
| 5,299,300 | A | 3/1994 | Femal et al. | |
| 5,309,125 | A | 5/1994 | Perkins et al. | |
| 5,311,070 | A | 5/1994 | Dooley | |
| 5,353,870 | A | 10/1994 | Harris | |

(Continued)

OTHER PUBLICATIONS

Office Action received from USPTO for U.S. Appl. No. 12/503,761. Sep. 29, 2011.

(Continued)

*Primary Examiner* — Graham Smith
(74) *Attorney, Agent, or Firm* — Kunzler Law Group

(57) ABSTRACT

An apparatus, system, and method are disclosed for phased array antenna communications. A phased array antenna tile includes a plurality of antenna elements. A beamformer module is integrated into the phased array antenna tile. The beamformer module is electrically coupled to each antenna element to process directional signals for the plurality of antenna elements. A plurality of cascadable connection points are disposed along a perimeter of the phased array antenna tile for connecting the phased array antenna tile to one or more additional phased array antenna tiles.

16 Claims, 6 Drawing Sheets

(56) References Cited

U.S. PATENT DOCUMENTS 5,369,309 A 11/1994 Bacrania et al.
5,382,916 A 1/1995 King et al.
5,386,194 A 1/1995 Moehlmann
5,390,364 A 2/1995 Webster et al.
5,412,426 A 5/1995 Totty
5,450,339 A 9/1995 Chester et al.
5,463,656 A 10/1995 Polivka et al.
5,471,131 A 11/1995 King et al.
5,481,129 A 1/1996 DeJong et al.
5,493,581 A 2/1996 Young et al.
5,548,542 A 8/1996 Rauth et al.
5,563,834 A 10/1996 Longway et al.
5,570,392 A 10/1996 Young et al.
5,574,572 A 11/1996 Malinowski et al.
5,574,671 A 11/1996 Young et al.
5,581,475 A 12/1996 Majors
5,583,856 A 12/1996 Weir
5,617,344 A 4/1997 Young et al.
5,619,496 A 4/1997 Weir
5,631,599 A 5/1997 Bacrania et al.
5,633,815 A 5/1997 Young
5,648,999 A 7/1997 Easterling et al.
5,651,049 A 7/1997 Easterling et al.
5,655,149 A 8/1997 Muegge et al.
5,659,261 A 8/1997 Bacrania et al.
5,687,196 A 11/1997 Proctor, Jr. et al.
5,701,097 A 12/1997 Fisher et al.
5,702,100 A 12/1997 Novick et al.
5,710,520 A 1/1998 Frey
5,719,584 A 2/1998 Otto
5,724,347 A 3/1998 Bell et al.
5,736,903 A 4/1998 Myers et al.
5,748,627 A 5/1998 Weir
5,757,263 A 5/1998 Ravindranathan
5,757,794 A 5/1998 Young
5,767,757 A 6/1998 Prentice
5,778,317 A 7/1998 Kaminsky
5,798,724 A 8/1998 Myers
5,802,211 A 9/1998 King
5,805,317 A 9/1998 Snawerdt, III et al.
5,825,621 A 10/1998 Giannatto et al.
5,828,664 A 10/1998 Weir
5,828,773 A 10/1998 Setlak et al.
5,835,062 A 11/1998 Heckaman et al.
5,835,349 A 11/1998 Giannatto et al.
5,852,670 A 12/1998 Setlak et al.
5,857,113 A 1/1999 Muegge et al.
5,861,858 A 1/1999 Niekamp
5,874,919 A 2/1999 Rawnick et al.
5,892,375 A 4/1999 Vulih et al.
5,892,480 A 4/1999 Killen
5,894,983 A 4/1999 Beck et al.
5,903,225 A 5/1999 Schmitt et al.
5,907,304 A 5/1999 Wilson et al.
5,920,640 A 7/1999 Salatino et al.
5,936,868 A 8/1999 Hall
5,940,045 A 8/1999 Belcher et al.
5,940,526 A 8/1999 Setlak et al.
5,952,982 A 9/1999 Jorgenson et al.
5,953,379 A 9/1999 Myers et al.
5,953,441 A 9/1999 Setlak
5,956,415 A 9/1999 McCalley et al.
5,960,047 A 9/1999 Proctor, Jr. et al.
5,963,679 A 10/1999 Setlak
RE36,388 E 11/1999 Fox et al.
5,982,619 A 11/1999 Giannatto et al.
5,990,830 A 11/1999 Vail et al.
5,995,062 A * 11/1999 Denney et al. ..... 343/853
5,999,145 A 12/1999 Niekamp
6,020,862 A 2/2000 Newton et al.
6,028,494 A 2/2000 May et al.
6,038,271 A 3/2000 Olaker et al.
6,043,722 A 3/2000 Vaninetti et al.
6,047,165 A 4/2000 Wright et al.
6,052,098 A 4/2000 Killen et al.
6,055,021 A 4/2000 Twitchell
6,061,228 A 5/2000 Palmer et al.
6,081,158 A 6/2000 Twitchell et al.
6,091,522 A 7/2000 Snawerdt, III et al.
6,091,765 A 7/2000 Pietzold, III et al.
6,097,260 A 8/2000 Whybrew et al.
6,104,914 A 8/2000 Wright et al.
6,108,523 A 8/2000 Wright et al.
6,115,005 A 9/2000 Goldstein et al.
6,130,585 A 10/2000 Whybrew et al.
6,140,978 A 10/2000 Patenaude et al.
6,144,704 A 11/2000 Startup et al. ..... 375/260
6,147,657 A 11/2000 Hildebrand et al.
6,148,179 A 11/2000 Wright et al.
6,154,636 A 11/2000 Wright et al.
6,154,637 A 11/2000 Wright et al.
6,160,998 A 12/2000 Wright et al.
6,163,681 A 12/2000 Wright et al.
6,166,705 A * 12/2000 Mast et al. ..... 343/853
6,166,709 A 12/2000 Goldstein
6,167,238 A 12/2000 Wright
6,167,239 A 12/2000 Wright et al.
6,172,652 B1 1/2001 Plonka
6,173,159 B1 1/2001 Wright et al.
6,181,296 B1 1/2001 Kulisan et al.
6,181,450 B1 1/2001 Dishman et al.
6,184,463 B1 2/2001 Panchou et al.
6,184,826 B1 2/2001 Walley et al.
6,185,255 B1 2/2001 Twitchell et al.
6,188,915 B1 2/2001 Martin et al.
6,195,060 B1 2/2001 Spano et al.
6,195,062 B1 2/2001 Killen et al.
6,204,823 B1 3/2001 Spano et al.
6,205,253 B1 3/2001 King
6,218,214 B1 4/2001 Panchou et al.
6,219,004 B1 4/2001 Johnson
6,222,658 B1 4/2001 Dishman et al.
6,226,531 B1 5/2001 Holt et al.
6,236,362 B1 5/2001 Walley et al.
6,236,371 B1 5/2001 Beck
6,240,290 B1 5/2001 Willingham et al.
6,243,051 B1 6/2001 Vanstrum et al.
6,243,052 B1 6/2001 Goldstein et al.
6,246,498 B1 6/2001 Dishman et al.
6,259,544 B1 7/2001 Dishman et al.
6,266,015 B1 7/2001 Heckaman et al.
6,269,125 B1 7/2001 Seccia et al.
6,271,799 B1 8/2001 Rief et al.
6,271,953 B1 8/2001 Dishman et al.
6,275,120 B1 8/2001 Vaninetti et al.
6,281,935 B1 8/2001 Twitchell et al.
6,281,936 B1 8/2001 Twitchell et al.
6,285,255 B1 9/2001 Luu et al.
6,289,487 B1 9/2001 Hessel et al.
6,292,133 B1 9/2001 Lynch
6,292,654 B1 9/2001 Hessel et al.
6,292,665 B1 9/2001 Hildebrand et al.
6,297,764 B1 10/2001 Wormington et al.
6,300,906 B1 10/2001 Rawnick et al.
6,307,510 B1 10/2001 Taylor et al.
6,307,523 B1 10/2001 Green et al.
6,308,044 B1 10/2001 Wright et al.
6,308,045 B1 10/2001 Wright et al.
6,320,546 B1 11/2001 Newton et al.
6,320,553 B1 11/2001 Ergene
6,323,819 B1 11/2001 Ergene
6,333,981 B1 12/2001 Weir et al.
6,335,766 B1 1/2002 Twitchell et al.
6,335,767 B1 1/2002 Twitchell et al.
6,342,870 B1 1/2002 Mehrkens et al.
6,343,151 B1 1/2002 King
6,343,207 B1 1/2002 Hessel et al.
6,344,830 B1 2/2002 Taylor
6,351,880 B1 3/2002 Palmer et al.
6,353,640 B1 3/2002 Hessel et al.
6,353,734 B1 3/2002 Wright et al.
6,356,240 B1 3/2002 Taylor
6,359,897 B1 3/2002 Hessel et al.
6,370,659 B1 4/2002 Maney

(56) References Cited

U.S. PATENT DOCUMENTS 6,381,265 B1 4/2002 Hessel et al.
6,384,773 B1 5/2002 Martin et al.
6,384,780 B2 5/2002 Walley et al.
6,388,621 B1 5/2002 Lynch
6,389,078 B1 5/2002 Hessel et al.
6,390,672 B1 5/2002 Vail et al.
6,397,083 B2 5/2002 Martin et al.
6,400,415 B1 6/2002 Danielsons
6,407,717 B2 6/2002 Killen et al.
6,411,612 B1 6/2002 Halford et al.
6,417,813 B1 7/2002 Durham
6,418,019 B1 7/2002 Snyder et al.
6,421,004 B2 7/2002 Walley et al.
6,421,012 B1 7/2002 Heckaman
6,421,022 B1 7/2002 Patenaude et al.
6,421,023 B1 7/2002 Phelan
6,424,685 B1 7/2002 Messel et al.
6,429,816 B1 8/2002 Whybrew et al.
6,434,200 B1 8/2002 Hessel
6,437,965 B1 8/2002 Adkins et al.
6,438,182 B1 8/2002 Olaker et al.
6,441,783 B1 8/2002 Dean ..... 342/372
6,441,801 B1 8/2002 Knight et al.
6,452,798 B1 9/2002 Smith et al.
6,456,244 B1 9/2002 Goldstein et al.
6,466,649 B1 10/2002 Walance et al.
6,466,773 B1 10/2002 Johnson
6,473,037 B2 10/2002 Vail et al.
6,473,133 B1 10/2002 Twitchell et al.
6,483,464 B2 11/2002 Rawnick et al.
6,483,705 B2 11/2002 Snyder et al.
6,492,903 B1 12/2002 Ranon
6,493,405 B1 12/2002 Olaker et al.
6,496,143 B1 12/2002 Vail et al.
6,501,437 B1 12/2002 Gyorko et al.
6,501,805 B1 12/2002 Twitchell
6,504,515 B1 1/2003 Holt et al.
6,512,487 B1 1/2003 Taylor et al.
6,519,010 B2 2/2003 Twitchell et al.
6,522,293 B2 2/2003 Vail et al.
6,522,294 B2 2/2003 Vail et al.
6,522,296 B2 2/2003 Holt
6,522,437 B2 2/2003 Presley et al.
6,522,867 B1 2/2003 Wright et al.
6,535,397 B2 3/2003 Clark et al.
6,535,554 B1 3/2003 Webster et al.
6,539,052 B1 3/2003 Hessel et al.
6,542,132 B2 4/2003 Stern
6,542,244 B1 4/2003 Rumpf et al.
6,545,648 B1 4/2003 Plonka
6,552,687 B1 4/2003 Rawnick et al.
6,563,472 B2 5/2003 Durham et al.
6,573,862 B2 6/2003 Vail et al.
6,573,863 B2 6/2003 Vail et al.
6,580,393 B2 6/2003 Holt
6,583,766 B1 6/2003 Rawnick et al.
6,587,077 B2 7/2003 Vail et al.
6,587,670 B1 7/2003 Hoyt et al.
6,590,942 B1 7/2003 Hessel et al.
6,591,375 B1 7/2003 Hu
6,593,881 B2 7/2003 Vail et al.
6,597,668 B1 7/2003 Schafer et al.
6,600,516 B1 7/2003 Danielsons et al.
6,606,055 B2 * 8/2003 Halsema et al. ..... 342/368
6,608,593 B2 8/2003 Holt
6,611,230 B2 8/2003 Phelan
6,628,851 B1 9/2003 Rumpf et al.
6,636,728 B1 * 10/2003 Avenel ..... 455/277.1
6,646,600 B2 11/2003 Vail et al.
6,646,614 B2 11/2003 Killen
6,646,621 B1 11/2003 Phelan et al.
6,665,353 B1 12/2003 Nisbet ..... 375/302
6,690,324 B2 2/2004 Vail et al.
6,708,032 B2 3/2004 Willingham et al.
6,711,528 B2 3/2004 Dishman et al.
6,717,549 B2 4/2004 Rawnick et al.
6,731,248 B2 5/2004 Killen et al.
6,734,827 B2 5/2004 Killen et al.
6,735,452 B1 5/2004 Foster, Jr. et al.
6,738,018 B2 5/2004 Phelan et al.
6,744,854 B2 6/2004 Berrier et al.
6,745,010 B2 6/2004 Wright et al.
6,748,240 B1 6/2004 Foster, Jr. et al.
6,751,266 B1 6/2004 Danielsons
6,753,744 B2 6/2004 Killen et al.
6,754,502 B2 6/2004 Hildebrand et al.
6,754,511 B1 6/2004 Halford et al.
6,771,221 B2 8/2004 Rawnick et al.
6,771,698 B1 8/2004 Beck
6,775,545 B2 8/2004 Wright et al.
6,778,516 B1 8/2004 Foster, Jr. et al.
6,781,540 B1 8/2004 MacKey et al.
6,781,560 B2 8/2004 Goldstein
6,788,268 B2 9/2004 Chiang et al. ..... 343/850
6,795,019 B2 9/2004 Holt
6,798,761 B2 9/2004 Cain et al.
6,804,208 B2 10/2004 Cain et al.
6,806,843 B2 10/2004 Killen et al.
6,812,906 B2 11/2004 Goldstein et al.
6,822,616 B2 11/2004 Durham et al.
6,824,307 B2 11/2004 Vail et al.
6,842,157 B2 1/2005 Phelan et al.
6,856,216 B1 2/2005 Trosa et al.
6,856,297 B1 2/2005 Durham et al.
6,861,975 B1 3/2005 Coleman, Jr. et al.
6,873,305 B2 3/2005 Rawnick et al.
6,876,274 B2 4/2005 Brown et al.
6,876,336 B2 4/2005 Croswell et al.
6,879,298 B1 4/2005 Zarro et al.
6,885,355 B2 4/2005 Killen et al.
6,888,500 B2 5/2005 Brown et al.
6,891,497 B2 5/2005 Coleman, Jr. et al.
6,891,501 B2 5/2005 Rawnick et al.
6,891,562 B2 5/2005 Spence et al.
6,894,550 B2 5/2005 Trosa et al.
6,894,582 B2 5/2005 Whybrew et al.
6,894,655 B1 5/2005 Jones et al.
6,897,829 B2 5/2005 Oliver et al.
6,900,763 B2 5/2005 Killen et al.
6,901,064 B2 5/2005 Cain et al.
6,901,123 B2 5/2005 England
6,903,703 B2 6/2005 Durham et al.
6,904,032 B2 6/2005 Cain
6,906,680 B2 6/2005 Rawnick et al.
6,909,404 B2 6/2005 Rawnick et al.
6,914,575 B2 7/2005 Rawnick et al.
6,927,745 B2 8/2005 Brown et al.
6,930,568 B2 8/2005 Snyder et al.
6,930,653 B2 8/2005 Rawnick et al.
6,931,362 B2 8/2005 Beadle et al.
6,937,120 B2 8/2005 Fisher et al.
6,943,699 B2 9/2005 Ziarno
6,943,731 B2 9/2005 Killen et al.
6,943,743 B2 9/2005 Durham et al.
6,943,748 B2 9/2005 Durham et al.
6,952,145 B2 10/2005 Brown et al.
6,952,148 B2 10/2005 Snyder et al.
6,954,179 B2 10/2005 Durham et al.
6,954,449 B2 10/2005 Cain et al.
6,956,532 B2 10/2005 Durham et al.
6,958,738 B1 10/2005 Durham et al.
6,958,986 B2 10/2005 Cain
6,960,965 B2 11/2005 Rawnick et al.
6,961,501 B2 11/2005 Matsuura et al.
6,965,355 B1 11/2005 Durham et al.
6,975,268 B2 12/2005 Coleman et al.
6,977,623 B2 12/2005 Durham et al.
6,982,987 B2 1/2006 Cain
6,985,118 B2 1/2006 Zarro et al.
6,985,349 B2 1/2006 Smyth et al.
6,990,319 B2 1/2006 Wright et al.
6,992,628 B2 1/2006 Rawnick et al.
6,993,440 B2 1/2006 Anderson et al.
6,993,460 B2 1/2006 Beadle et al.

(56) References Cited

U.S. PATENT DOCUMENTS 6,995,711 B2 2/2006 Killen et al.
6,998,937 B2 2/2006 Brown et al.
6,999,044 B2 2/2006 Durham et al.
6,999,163 B2 2/2006 Pike
7,006,052 B2 2/2006 Delgado et al.
7,009,570 B2 3/2006 Durham et al.
7,012,482 B2 3/2006 Rawnick et al.
7,023,384 B2 4/2006 Brown et al.
7,023,392 B2 4/2006 Brown et al.
7,027,409 B2 4/2006 Cain
7,030,834 B2 4/2006 Delgado et al.
7,031,295 B2 4/2006 Schafer
7,038,625 B1 5/2006 Taylor et al.
7,046,104 B2 5/2006 Snyder et al.
7,053,861 B2 5/2006 Rawnick et al.
7,054,289 B1 5/2006 Foster, Jr. et al.
7,068,219 B2 6/2006 Martin et al.
7,068,605 B2 6/2006 Cain et al.
7,068,774 B1 6/2006 Judkins et al.
7,079,260 B2 7/2006 Montgomery
7,079,552 B2 7/2006 Cain et al.
7,079,576 B2 7/2006 Bologna et al.
7,084,827 B1 8/2006 Strange et al.
7,085,290 B2 8/2006 Cain et al.
7,085,539 B2 8/2006 Furman
7,088,308 B2 8/2006 Delgado et al.
7,102,588 B1 9/2006 Phelan et al.
7,110,779 B2 9/2006 Billhartz et al.
7,141,129 B2 11/2006 Smyth et al.
7,148,459 B2 12/2006 Williford et al.
7,170,461 B2 1/2007 Parsche
7,173,577 B2 2/2007 Brown et al.
7,184,629 B2 2/2007 Montgomery et al.
7,187,326 B2 3/2007 Beadle et al.
7,187,340 B2 3/2007 Kralovec et al.
7,187,827 B2 3/2007 Montgomery et al.
7,188,473 B1 3/2007 Asada et al.
7,190,860 B2 3/2007 Montgomery et al.
7,205,949 B2 4/2007 Turner
7,216,282 B2 5/2007 Cain
7,221,181 B2 5/2007 Chao et al.
7,221,322 B1 5/2007 Durham et al.
7,224,866 B2 5/2007 Montgomery et al.
7,236,679 B2 6/2007 Montgomery et al.
7,242,327 B1 7/2007 Thompson
7,255,535 B2 8/2007 Albrecht et al.
7,285,000 B2 10/2007 Pleskach et al.
7,286,734 B2 10/2007 Montgomery et al.
7,292,640 B2 11/2007 Nieto et al.
7,293,054 B2 11/2007 Clements et al.
7,299,038 B2 11/2007 Kennedy et al.
7,302,185 B2 11/2007 Wood et al.
7,304,609 B2 12/2007 Roberts
7,304,972 B2 12/2007 Cain et al.
7,321,298 B2 1/2008 Judkins et al.
7,321,777 B2 1/2008 Billhartz et al.
7,328,012 B2 2/2008 Ziarno et al.
7,333,057 B2 2/2008 Snyder
7,333,458 B2 2/2008 Cain
7,336,242 B2 2/2008 Phelan et al.
7,342,801 B2 3/2008 Jandzio et al.
7,346,241 B2 3/2008 Montgomery et al.
7,348,929 B2 3/2008 Phelan et al.
7,358,921 B2 4/2008 Snyder et al.
7,369,819 B2 5/2008 Luu
7,372,423 B2 5/2008 Packer et al.
7,382,765 B2 6/2008 Kennedy et al.
7,392,229 B2 6/2008 Harris et al.
7,394,826 B2 7/2008 Cain et al.
7,408,519 B2 8/2008 Durham et al.
7,408,520 B2 8/2008 Durham et al.
7,409,240 B1 8/2008 Bishop
7,414,424 B2 8/2008 Chao et al.
7,415,178 B2 8/2008 Montgomery et al.
7,415,335 B2 8/2008 Bell et al.
RE40,479 E 9/2008 Wright et al.
7,420,519 B2 9/2008 Durham et al.
7,424,187 B2 9/2008 Montgomery et al.
7,426,387 B2 9/2008 Wright et al.
7,426,388 B1 9/2008 Wright et al.
7,428,412 B2 9/2008 Wright et al.
7,433,392 B2 10/2008 Nieto et al.
7,433,430 B2 10/2008 Wadsworth et al.
7,444,146 B1 10/2008 Wright et al.
7,453,409 B2 11/2008 Zimmerman et al.
7,453,414 B2 11/2008 Parsche
7,453,864 B2 11/2008 Kennedy et al.
7,456,756 B2 11/2008 Ziarno
7,463,210 B2 12/2008 Rawnick et al.
7,468,954 B2 12/2008 Sherman
7,469,047 B2 12/2008 Judkins et al.
7,479,604 B1 1/2009 Smith et al.
7,487,131 B2 2/2009 Harris et al.
7,496,384 B2 2/2009 Seto et al. ..... 455/562.1
7,499,287 B2 3/2009 Jandzio et al.
7,499,515 B1 3/2009 Beadle
7,505,009 B2 3/2009 Parsche et al.
7,518,372 B2 4/2009 Schilling et al.
7,518,779 B2 4/2009 Wasilousky
7,526,022 B2 4/2009 Nieto
7,528,844 B2 5/2009 Deschamp
7,538,929 B2 5/2009 Wasilousky
7,546,123 B2 6/2009 Wright et al.
7,554,499 B2 6/2009 Munk et al.
7,555,064 B2 6/2009 Beadle
7,555,131 B2 6/2009 Hollowbush et al.
7,555,179 B2 6/2009 Montgomery et al.
7,557,702 B2 7/2009 Eryurek et al.
7,561,024 B2 7/2009 Rudnick
7,567,256 B2 7/2009 Hollowbush et al.
7,570,713 B2 8/2009 Jao et al.
7,573,431 B2 8/2009 Parsche
7,577,899 B2 8/2009 Nieto et al.
7,583,950 B2 9/2009 Russell et al.
7,593,488 B2 9/2009 Furman et al.
7,593,641 B2 9/2009 Tegge, Jr.
7,595,739 B2 9/2009 Ziarno
7,598,918 B2 10/2009 Durham et al.
7,603,612 B2 10/2009 Nieto
7,607,223 B2 10/2009 Pleskach et al.
7,620,374 B2 11/2009 Ziarno et al.
7,620,881 B2 11/2009 Nieto
7,623,833 B2 11/2009 Cabrera et al.
7,627,803 B2 12/2009 Nieto et al.
7,631,243 B2 12/2009 Nieto
7,649,421 B2 1/2010 Victor
7,649,951 B2 1/2010 Moffatt
7,657,825 B2 2/2010 Norris et al.
7,667,888 B2 2/2010 Wasilousky
7,676,205 B2 3/2010 Moffatt et al.
7,676,736 B2 3/2010 Norris et al.
7,688,138 B2 3/2010 Hehn
7,729,336 B2 6/2010 Pun et al.
7,733,667 B2 6/2010 Qin et al.
7,738,548 B2 6/2010 Roberts et al.
7,750,861 B2 7/2010 Delgado et al.
7,751,488 B2 7/2010 Moffatt
7,755,512 B2 7/2010 Ziarno
7,755,553 B2 7/2010 Packer et al.
7,756,134 B2 7/2010 Smith et al.
7,761,009 B2 7/2010 Bloom
7,769,028 B2 8/2010 Boley et al.
7,769,376 B2 8/2010 Wright et al.
7,778,651 B2 8/2010 Billhartz
7,782,398 B2 8/2010 Chan et al.
7,782,978 B2 8/2010 Mattsson
7,788,219 B2 8/2010 Harris
7,808,441 B2 10/2010 Parsche et al.
7,809,410 B2 10/2010 Palum et al.
7,813,408 B2 10/2010 Nieto et al.
7,813,433 B2 10/2010 Moffatt
7,831,154 B2 11/2010 Alwan et al.
7,831,892 B2 11/2010 Norris et al.
7,831,893 B2 11/2010 Norris et al.

(56) References Cited

U.S. PATENT DOCUMENTS

| | | | | |
|---|---|---|---|---|
| 7,840,199 | B2 | 11/2010 | Krishnaswamy et al. | 455/147 |
| 7,855,681 | B2 | 12/2010 | Minear et al. | |
| 7,855,997 | B2 | 12/2010 | Adams et al. | |
| 7,856,012 | B2 | 12/2010 | Smith et al. | |
| 7,860,147 | B2 | 12/2010 | Moffatt | |
| 7,860,200 | B2 | 12/2010 | Furman et al. | |
| 7,864,835 | B2 | 1/2011 | Furman et al. | |
| 7,869,828 | B2 | 1/2011 | Wang et al. | 455/561 |
| 7,877,209 | B2 | 1/2011 | Harris et al. | |
| 7,880,722 | B2 | 2/2011 | Harris | |
| 7,894,509 | B2 | 2/2011 | Smith et al. | |
| 7,903,749 | B2 | 3/2011 | Moffatt | |
| 7,907,417 | B2 | 3/2011 | Jandzio et al. | |
| 7,911,385 | B2 | 3/2011 | Heuser | |
| 7,921,145 | B2 | 4/2011 | Michaels | |
| 7,937,427 | B2 | 5/2011 | Chester et al. | |
| 7,948,766 | B2 | 5/2011 | Jandzio et al. | |
| 7,969,358 | B2 | 6/2011 | Martin et al. | |
| 7,970,365 | B2 | 6/2011 | Martin et al. | |
| 7,990,860 | B2 | 8/2011 | Smith et al. | |
| 7,995,678 | B2 | 8/2011 | Norris et al. | |
| 7,995,749 | B2 | 8/2011 | Michaels | |
| 2009/0104885 | A1 | 4/2009 | Asayama et al. | 455/296 |
| 2009/0251377 | A1* | 10/2009 | Peng et al. | 343/795 |

OTHER PUBLICATIONS

Notice of Allowance received from USPTO for U.S. Appl. No. 12/503,761. Feb. 6, 2012.

* cited by examiner

APPARATUS, SYSTEM, AND METHOD FOR INTEGRATED MODULAR PHASED ARRAY TILE CONFIGURATION

CROSS-REFERENCES TO RELATED APPLICATIONS

This application claims priority to U.S. Provisional Patent Application No. 61/259,608 entitled "APPARATUS, SYSTEM, AND METHOD FOR INTEGRATED MODULAR PHASED ARRAY TILE CONFIGURATION" and filed on Nov. 9, 2009 for Karl F. Warnick, which is incorporated herein by reference.

FIELD OF THE INVENTION

This invention relates to phased arrays and more particularly relates to integrated modular phased arrays.

BACKGROUND

Description of the Related Art

Phased array systems employ an array of antennas to permit directional signal reception and/or transmission. The array may be one-, two-, or three-dimensional. Arrays operate on a principle similar to that of a diffraction grating, in which the constructive and destructive interference of evenly spaced waveforms cause a signal of interest arriving from one angular direction to be strengthened, while signals from other angular directions are attenuated. By separately controlling the phase and the amplitude of the signal at each antenna of the phased array, the angular direction of travel of the signal of interest may be selectively enhanced and undesired signals may be excluded.

For example, consider a simple linear array of antennas spaced evenly a distance d apart, receiving/transmitting a signal of wavelength $\lambda$ at an angle $\theta$ from the vertical. The time of arrival of the signal to/from each antenna will be successively delayed, manifesting itself as a phase shift of $(2\pi d/\lambda)\sin\theta$ modulo $2\pi$. By incrementally shifting the phase of the signal to/from each successive antenna by that amount, the combined signal to/from the array will be strengthened in the direction of angle $\theta$.

Existing circuitry to shift the phase of a radio frequency ("RF") signal by a variable amount is expensive, bulky, and not well-suited to integration on a chip. Because the circuitry must be replicated for each antenna in the phased array, the overall system cost becomes prohibitive for many applications.

SUMMARY

From the foregoing discussion, it should be apparent that a need exists for an apparatus, system, and method for phased array antenna communications. Beneficially, such an apparatus, system, and method would be integrated and modular.

The present invention has been developed in response to the present state of the art, and in particular, in response to the problems and needs in the art that have not yet been fully solved by currently available phased array systems. Accordingly, the present invention has been developed to provide an apparatus, system, and method for phased array antenna communications that overcome many or all of the above-discussed shortcomings in the art.

The apparatus for phased array antenna communications is provided with a plurality of modules configured to functionally execute the necessary steps of transmitting and/or receiving signals. These modules in the described embodiments include a phased array antenna tile, a beamformer module, a plurality of cascadable connection points, one or more low noise amplifiers, and one or more power amplifiers.

In one embodiment, the phased array antenna tile includes a plurality of antenna elements. In one embodiment, the beamformer module is integrated into the phased array antenna tile. The beamformer module, in a further embodiment, is electrically coupled to each antenna element to process directional signals for the antenna elements. The beamformer module, in one embodiment, includes an integrated chip.

In one embodiment, the plurality of cascadable connection points are disposed along a perimeter of the phased array antenna tile. The cascadable connection points, in another embodiment, connect the phased array antenna tile to one or more additional phased array antenna tiles. The cascadable connection points, in one embodiment, include attachment fixtures that mechanically connect the phased array antenna tile to the one or more additional phased array antenna tiles. In a further embodiment, the cascadable connection points include radio-frequency ("RF") inputs, RF outputs, direct current ("DC") connections, control lines, signal grounds, and/or power grounds.

In one embodiment, the one or more low noise amplifiers are integrated into the phased array antenna tile. The phased array antenna tile, in another embodiment, includes a receiver and the beamformer module receives the directional signals from the plurality of antenna elements. The one or more low noise amplifiers, in one embodiment, are disposed between the plurality of antenna elements and the beamformer module. In another embodiment, the one or more low noise amplifiers are integrated with the beamformer module.

In one embodiment, the one or more power amplifiers are integrated into the phased array antenna tile. The phased array antenna tile, in another embodiment, includes a transmitter and the beamformer module provides the directional signals to the plurality of antenna elements. In a further embodiment, the one or more power amplifiers are disposed between the plurality of antenna elements and the beamformer module. In another embodiment, the one or more power amplifiers are integrated with the beamformer module.

A system of the present invention is also presented for phased array antenna communications. The system may be embodied by a plurality of phased array antenna tiles, a beamformer module, a plurality of cascadable connection points, and an interface module. In particular, the system, in one embodiment, includes one or more low noise amplifiers and/or one or more power amplifiers.

In one embodiment, the plurality of phased array antenna tiles are each juxtaposed in a regular pattern. Each phased array antenna tile, in a further embodiment, includes a plurality of antenna elements. In another embodiment, the plurality of phased array antenna tiles includes one or more of a receiver and a transmitter. In one embodiment, a beamformer module is integrated into each phased array antenna tile. Each beamformer module, in another embodiment, is electrically coupled to each antenna element of a corresponding phased array antenna tile to process directional signals for the plurality of antenna elements. The beamformer modules, in one embodiment, each include an integrated chip.

In one embodiment, the plurality of cascadable connection points are each disposed along a perimeter of each phased array antenna tile. A subset of connection points on one phased array antenna tile, in a further embodiment, mate with a corresponding subset of connection points on one or more juxtaposing phased array antenna tiles. In another embodiment, the cascadable connection points include attachment fixtures that mechanically connect the plurality of phased array antenna tiles. The cascadable connection points, in one embodiment, include one or more of radio-frequency ("RF") inputs, RF outputs, direct current ("DC") connections, control lines, signal grounds, and power grounds. In one embodiment, the interface module connects to a subset of connection points not mated between juxtaposing phased array antenna tiles.

In one embodiment, the one or more low noise amplifiers are integrated into each phased array antenna tile. The plurality of phased array antenna tiles, in a further embodiment, includes a receiver and the beamformer modules receive the directional signals from the plurality of antenna elements. The one or more power amplifiers, in one embodiment, are integrated into each phased array antenna tile. The plurality of phased array antenna tiles, in a further embodiment, includes a transmitter and the beamformer modules provide the directional signals to the plurality of antenna elements.

Another apparatus for phased array antenna communications is provided with a plurality of modules configured to functionally execute the necessary steps of transmitting and/or receiving signals. These modules in the described embodiments include a phased array antenna tile, a beamformer module, a plurality of cascadable connection points, and one or more duplexer circuits.

In one embodiment, the phased array antenna tile includes a plurality of antenna elements. In one embodiment, the beamformer module is integrated into the phased array antenna tile. The beamformer module, in a further embodiment, is electrically coupled to each antenna element to process directional signals for the antenna elements. The beamformer module, in one embodiment, sends directional transmit signals to the plurality of antenna elements. In another embodiment, the beamformer module receives directional receive signals from the plurality of antenna elements.

In one embodiment, the plurality of cascadable connection points are disposed along a perimeter of the phased array antenna tile. The cascadable connection points, in another embodiment, connect the phased array antenna tile to one or more additional phased array antenna tiles. In one embodiment, the one or more duplexer circuits are electrically coupled to the plurality of antenna elements. The one or more duplexer circuits, in a further embodiment, allow each antenna element to both transmit and receive. In another embodiment, the plurality of antenna elements includes one or more transmit antenna elements interleaved among one or more receive antenna elements.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
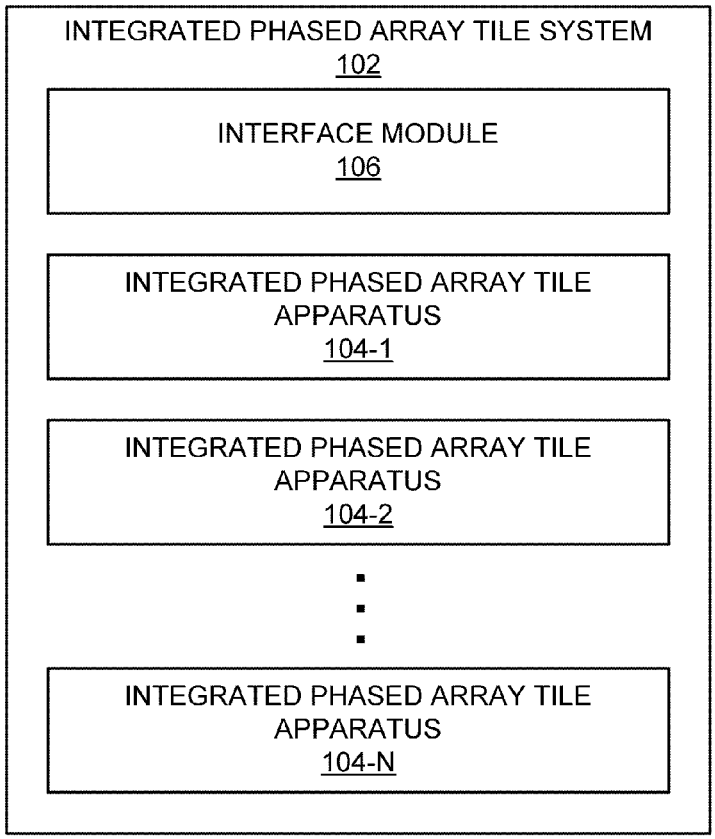
FIG. 1 is a schematic block diagram illustrating one embodiment of an integrated phased array tile system in accordance with the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the software portions are stored on one or more computer readable mediums.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing.

More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Aspects of the present invention are described below with reference to schematic flowchart diagrams and/or schematic block diagrams of methods, apparatuses, systems, and computer program products according to embodiments of the invention. It will be understood that each block of the schematic flowchart diagrams and/or schematic block diagrams, and combinations of blocks in the schematic flowchart diagrams and/or schematic block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods and computer program products according to various embodiments of the present invention. In this regard, each block in the schematic flowchart diagrams and/or schematic block diagrams may represent a module, segment, or portion of code, which comprises one or more executable instructions for implementing the specified logical function(s).

It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and computer instructions.

FIG. 1 depicts one embodiment of an integrated phased array tile system 102. The system 102, in certain embodiments, may reduce the total number of elements required in a phased array antenna application. The system 102, in another embodiment, may include optimized antenna elements specific to some typical satellite applications.

The system 102, in one embodiment, may manage 500 Mhz in signal band cost efficiently in a truly adaptive array. The system 102, in a further embodiment, may include an adaptive analog beamforming architecture that allows some digital-like beamforming benefits while keeping the signal processing in the analog domain until combining (at least to the tile level, allowing true digital beamforming more cost effectively at a secondary or tile level, in certain embodiments).

The system 102, in some embodiments, may reduce the cost of the electronics used in the array when compared to alternative implementations. In one embodiment, the system 102 may include a chip set leveraging adaptive analog beamforming with multiple beamforming channels. In certain embodiments, the number of beamforming channels may be eight. Each channel, in one embodiment, contains the analog components needed for adaptive analog beamforming, such as one receive ("Rx") chip, one transmit ("Tx") chip, and so forth. These chips, in certain embodiments, leverage a low cost SiGe BiCMOS process. For example, in some embodiments, the total realized cost savings may be 12× to 20×, or the like.

In the depicted embodiment, the system 102 includes several integrated phased array tiles 104. The system 102, in one embodiment, maximizes volume at each level of a components hierarchy in order to most rapidly achieve economies of scale. In other words, full array assemblies of many given aperture dimensions (i.e. different embodiments of the integrated phased array tile system 102) would leverage a common "tile" component 104; while the "tiles" 104 may leverage common element panel designs, common beamforming chips, or the like. (The architecture of these chips, in certain embodiments, is such that design flexibility is very high in addressing multiple concurrent beamforming, dual polarization, etc.)

The system 102, in one embodiment, maximizes antenna performance by providing on-board beamforming algorithms that are custom defined or specific to an application and that can be loaded on a programmable digital controller on board each beamforming chip. For example, in one embodiment, each integrated phased array tile 104 may include one or more beamforming chips, or the like.

In the depicted embodiment, the system 102 includes a plurality of integrated phased array tiles 104 juxtaposed side by side in a predefined pattern. In one embodiment, a subset of connection points on one tile 104 mate with a corresponding subset of connection points on one or more adjacent juxtaposing tiles 104. For example, a lower edge of tile 104-1 may mate with an upper edge of tile 104-2. In one embodiment, a tile 104 interface mechanically with one or more adjacent tiles 104 for structural support. In another embodiment, a tile 104 interfaces electrically with one or more adjacent tiles 104. For example, in certain embodiments, the system 102 may include one or more electrical connections between adjacent tiles 104, such as radio-frequency ("RF") inputs, RF outputs, direct current ("DC") connections, control lines, signal grounds, power grounds, and/or other electrical connections.

An interface module 106, in certain embodiments, connects to a subset of connection points not mated between juxtaposing tiles 104. In one embodiment, an interface module 106 is disposed along a single edge of a tile 104 or set of tiles 104, such as an upper edge of tile 104-1, or the like. Several interface modules 106, in a further embodiment, may be disposed along different edges of a tile 104 or set of tiles 104, such as along an upper edge of tile 104-1 and along a lower edge of tile 104-N, or the like. In another embodiment, the interface module 106 may include a frame around a perimeter of the tiles 104, or the like. The interface module 106, in one embodiment, provides structural support for the tiles 104. In another embodiment, the interface module 106 provides electrical connections between the tiles 104 and an external component, such as control circuitry, a power source, and/or the like.

Figure 2:
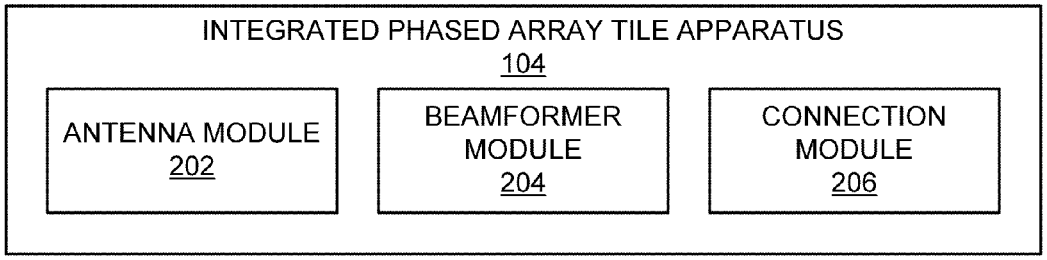
FIG. 2 is a schematic block diagram illustrating one embodiment of an integrated phased array tile apparatus in accordance with the present invention.

FIG. 2 depicts one embodiment of an integrated phased array tile apparatus 104. In the depicted embodiment, the integrated phased array tile apparatus 104 includes an antenna module 202, a beamformer module 204, and a connection module 206. The antenna module 202, in one embodiment, includes one or more phased array antennas. The beamformer module 204, in certain embodiments, includes a beamformer chip integrated into a tile 104. The connection module 206, in one embodiment, includes one or more cascadable connection points disposed along a perimeter of a tile 104 for mechanical and/or electrical connections between tiles 104.

In one embodiment, several integrated phased array tile apparatuses 104 are connected to form a low cost phased array antenna such as the integrated phased array tile system 102 described above with regard to FIG. 1. In certain embodiments, the use of modular array tiles 104 enable high quantity manufacturing of array tiles 104 for multiple products, rather than using a custom RF backplane design for each product. Further, in various embodiments, instead of using a transmit/receive ("T/R") module for each array antenna element, with a high overall antenna cost, an array tile 104 includes a T/R module (i.e. the beamformer module 204) for several antenna elements of the antenna module 202, providing an optimal compromise between modularity and integration.

Each tile 104 includes, in one embodiment, an aperture with multiple array antenna elements 202, an RF board that feeds the antenna elements 202 using an integrated analog beamformer chip 204, and one or more connectors 206 for RF inputs and outputs, DC power, and/or control lines. Integrated phased array tiles 104, in various embodiments, may be used in phased array antennas for broadcasting satellite service ("BSS"), direct broadcast satellite ("DBS"), very small aperture terminals ("VSAT"), communications, radars, and/or other applications.

The tiles 104, in various embodiments, may be configured to receive, to transmit, or to both receive and transmit (i.e.

shared aperture). Phased arrays, such as the integrated phased array tile system 102 described above can be designed for a horizon to horizon ("full-sky") field of view, a limited field of view, etc. In one embodiment, the design is primarily dictated by the expected angular range of the source of interest relative to the phased array antenna. One advantage of a full-sky array is a wider range of angles of arrival for which the source signal can be acquired. An advantage of a limited field of view array is that a higher antenna gain can be realized for a given number of antenna elements 202. The field of view of an array is typically determined by the radiation pattern of the antenna elements 202 in the array 102 and by the decrease in antenna gain ("scan loss") as the beam is steered. For the DBS and BSS applications, in-motion arrays, in one embodiment, include tiles 104 with a full-sky field of view, or a limited field of view array with a rough-pointing mechanical platform that maintains the orientation of antenna elements of the antenna module 202 so that the source of interest remains within the field of view of the array 102. Examples of limited array fields of view include the sky arc occupied by satellites in geostationary orbit ("GSO") as viewed from a given range of latitudes and an omnidirectional pattern over a limited range of elevation angles for a phased array antenna system 102 on a rotating, horizontal platform, or the like.

In certain embodiments, the system 102 may include a hybrid array that includes a combination of limited field of view elements and full-sky or omnidirectional elements. For example, the system 102 may be designed to receive signals from both GSO satellites and nonstationary low earth orbit ("LEO") or medium earth orbit ("MEO") satellites, or the like.

Various embodiments of the system 102 may scan in one dimension, in two dimensions, or the like. A one dimensional ("1D") scanning array 102 is typically designed to steer a beam over a one-dimensional arc in the sky. A two dimensional ("2D") array 102 typically steers a beam over a solid angular region. 2D arrays offer greater flexibility but often include more elements than a 1D array. For fixed array applications with satellites in geostationary orbit, a 1D array can be implemented to steer the antenna beam along the GSO arc to point at a desired satellite.

Shared aperture tiles 104 can be used to combine transmit and receive functions in one phased array antenna 102. Multiple frequency bands can also be combined using the shared aperture approach. Dual or multiband antenna elements 202 can be used to achieve this, or antennas 202 for a lower frequency band can be interspersed between more densely packed higher band antenna elements 202. An example of a dual frequency array is a combined Ku and Ka band system, or the like.

In one embodiment, the beamformer module 204 includes a beamformer integrated circuit chip that includes several beamformers, such as two four element beamformers, or the like. In other embodiments, the beamformer module 204 may use different polarization configurations for tiles 104 having beamformer chips with a different number of inputs 206 (receive) or outputs 206 (transmit). In order to increase the level of system integration, in certain embodiments, the beamformer module 204 may include multiple beamformer chips per tile to increase the number of antenna elements 202 per tile 104.

In an embodiment with a beamformer chip 204 with two four element beamformers, the array tile 104, in certain embodiments, may be constructed in at least three example configurations. In one embodiment, a tile 104 with two four element beamformers may include eight single polarization antenna elements 202 with one RF output connection 206 corresponding to the polarization of the antenna elements 202 (linear or circular). In another embodiment, a tile 104 with two four element beamformers may include four dual-polarized antenna elements 202 with two RF output connections 206 for two orthogonal polarizations (horizontal/vertical linear or right hand/left hand circular), allowing electronics after the phased array antenna system 102 to select the final polarization. This embodiment is a dual polarized phased array 102. An antenna for satellite applications with two orthogonal polarization outputs may be referred to as universal polarization. In a further embodiment, a tile 104 with two four element beamformers may include four dual-polarized antenna elements 202 with electronically selected or rotated polarization. Such a tile 104 may have one RF output connection 206 and may include additional electronics before or after the beamformer chip 204 to select one of two orthogonal polarizations or to rotate the polarization of the tile 104, or the like.

For a receive array tile system 102, in certain embodiments, each array tile 104 includes the antenna elements 202, one or more discrete low noise amplifiers, an integrated analog beamformer 204, and/or one or more connections 206, such as RF, control, DC power, and/or other input/output lines.

The antenna elements 202 of a tile 104, in one embodiment, are designed such that the phased array 102 has a selected field of view. For a phased array 102 with full sky field of view, the antenna elements 202, in certain embodiments, may be electrically small and spaced nominally one half the wavelength at the high end of the operating bandwidth. For an array 102 with limited field of view, in certain embodiments, the antenna elements 202 may be electrically larger and custom designed for the designed field of view. In a further embodiment, the antenna elements 202 may include limited field of view elements, such as corporate fed, passive phased arrays or other antenna types that realize a selected field of view.

For high sensitivity applications such as DBS and VSAT antennas, a tile 104 may include one or more discrete low noise amplifiers ("LNAs") that amplify output signals of the antenna elements 202 before the beamformer electronics 204, or the like. To minimize noise introduced by transmission line and interconnect losses, the LNAs may be located as close as possible to the antenna elements 202. Radio frequency connector cables or PCB traces, in certain embodiments, may connect the antenna elements 202 to the LNA inputs and the LNA outputs to the beamformer inputs of the beamformer module 204. The LNAs, in a further embodiment, may be attached directly to the terminals of the antenna elements 202 to reduce connector losses.

One major cost driver for a phased array antenna 102, in certain embodiments, may be the beamformer electronics 204. To minimize the cost of this component of the system 102, the beamformer module 204 for a tile 104, in certain embodiments, may be integrated onto a single chip. Further cost reduction can be obtained, in a further embodiment, by integrating the beamformer electronics 204 for multiple array antenna elements 202 on one chip. A beamformer chip 204, in certain embodiments, may include the LNAs described above, phase shifters, variable gain amplifiers, a combiner, and/or other elements. One embodiment of an architecture for phase-only beam steering includes phase shifters and a combiner, but other components may be included to increase the utility of the beamformer 204 as needed.

In one embodiment, the beamformer module 204 controls amplitudes for the antenna elements 202. Amplitude control, in certain embodiments, allows more precise control of the antenna beam pattern, including reduction of sidelobes to reduce ground noise and meet regulatory pattern mask requirements. The beamformer module 204, in various embodiments, may use digital and/or analog beamforming. For broadband consumer applications, in certain embodiments, the beamformer module 204 uses analog beamforming to enable broadband processing at a lower cost than digital beamforming. The beamformer module 204, in one embodiment, combines signals from the antenna elements 202 of a tile to produce an RF output signal 206 corresponding to a steered beam, with each RF input signal 206 shifted in phase and amplitude according to phase and gain control signals 206.

For applications such as multi-user terminals, in certain embodiments, a tile 104 may form multiple simultaneous beams. In one embodiment, outputs of the antenna elements 202 are split after the LNAs, if present, and the signals are routed to inputs of multiple beamformer chips 204. Each beamformer chip 204, in one embodiment, forms a separate, independently steerable beam.

In one embodiment, the connection module 206 for a tile includes one RF output per polarization. In a further embodiment, the connection module 206 for a tile 104 includes one or more DC input connectors for the tile 104 that provide power to the beamformer chip 204, LNAs, and/or other electronics. Digital input lines of the connection module 206, in one embodiment, provide control signals to select the amplitude and phase states used by the beamformer chip 204 to create an electronically steered antenna beam. In one embodiment, a system beamformer control module for the system 102, with embedded digital signal processing hardware or the like, generates digital amplitude and phase control signals that are distributed to the phased array tiles 104 of the system 102. In another embodiment, a beamformer control module may be integrated with the beamformer chip 204 of a tile 104 using a mixed-signal analog and digital architecture, or the like.

For a transmit array tile system 102, in certain embodiments each tile 104 includes the antenna elements 202, one or more discrete power amplifiers, one or more integrated analog beamformers 204, and/or one or more connections 206, such as RF, control, DC power input/output lines, or the like.

To provide adequate radiated power for a transmit array tile system 102, in certain embodiments, one or more discrete power amplifiers may amplify a signal level arriving at an input connection 206 to an appropriate power level. One or more power amplifiers, in one embodiment, may be integrated on the beamformer chip 204. In another embodiment, discrete power amplifiers may be used for applications with power usage that is too great for integrated RF electronics. In one embodiment, sufficient total power for a full-sky array 102 with many elements using on-chip power amplifiers. In other embodiments, off-chip power amplifiers may be used. In certain embodiments, such as for some limited field of view arrays or high-power uplinks, on-chip amplifiers may not generate sufficient power, so off-chip power amplifiers may be used. Off-chip power amplifiers, in one embodiment, may be located between the beamformer 204 and the antenna elements 202.

For a transmit array tile 104, in certain embodiments, the beamformer 204 has one RF input from the connection module 206 per polarization. In a further embodiment, each RF input of the beamformer 204 is split into separate signal paths with individually controllable phase shifters, variable gain amplifiers, and/or other elements. After phase shifting, gain control, and/or amplification, in one embodiment, the RF outputs from the beamformer module 204 are each connected to array antenna elements 202. In certain embodiments, additional electronics, including power amplification and other functions, may be located between the RF outputs of the beamformer module 204 and the array antenna elements 202.

In one embodiment, a transmit array tile 104 uses more power from a DC power connection of the connection module 206 than a receive array tile 104. A connection module 206 for a transmit array tile 104, in one embodiment, includes one RF signal input per polarization.

The connection module 206 of a tile 104, in certain embodiments, may include one or more mechanical attachment fixtures that allow tiles 104 to be snapped together or otherwise connected during manufacture of a phased array system 106. The attachment fixtures of the connection module 206, in various embodiments, may include one or more alignment pins, guides, flanges, or the like disposed along a perimeter of a tile 104. The attachment fixtures of the connection module 206, in one embodiment, may be designed to be low cost but to maintain accurate relative positioning between antenna elements 202 on adjacent array tiles 104. The assembled array 102, in one embodiment, may be designed to be sufficiently stable to survive high winds, vibration and acceleration on a mobile platform, and/or other sources of mechanical shocks.

In one embodiment, the electronic connections 206 for a tile 104, such as RF signal lines, DC power, and/or digital control lines, may be connected to a power supply and beamformer control unit for the array system 102 with individual connectors on a back or side of each tile 104. The connectors, in various embodiments, may mate with flexible cables, fixed connectors on a large PCB backplane, or the like. In a further embodiment, one or more of the connections of the connection module 206 may be located on a side of the tiles 104 and/or integrated with an attachment fixture of the connection module 206, so that adjacent tiles may be joined electrically as well as mechanically. For a receive array system 102, each tile 104, in certain embodiments, may include an RF input of the corresponding connection module 206, which is added in a combiner to the signal produced by the tile 104 and output to an output connector of the connection module 206 that is daisy chained to the next tile 104 in the array 102. In one embodiment, the RF signals may be combined to maintain equal phase lengths from a master connector on one center tile 104 for the entire array 102, a center tile 104 for each row in the array 102, a supporting RF backplane, or the like.

Figure 3:
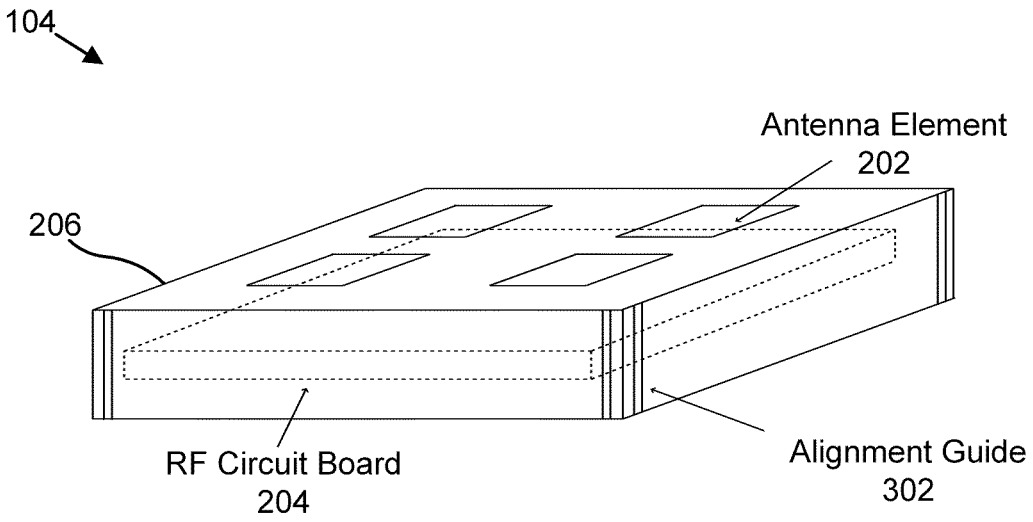
FIG. 3 is a perspective view illustrating one embodiment of an integrated phased array tile in accordance with the present invention.

FIG. 3 depicts one embodiment of an integrated phased array tile 104. The beamformer module 204, in one embodiment, may include one or more integrated chips and/or circuit boards embedded within the tile 104. The phased array antenna elements 202, in certain embodiments, may be disposed on an upper surface of the tile 104. The cascadable connection points 206, in various embodiments, may include mechanical connections, electrical connections such as RF inputs, RF outputs, DC connections, control lines, signal grounds, power grounds, and the like, and/or other mechanical or electrical connections. The connection points 206, in one embodiment, include one or more alignment guides 302 and/or another mechanical attachment fixtures to properly juxtapose, align, and/or connect a plurality of tiles 104 in a regular pattern, further ensuring that the connection points 206 between juxtaposing tiles 104 make proper contact.

Figure 4:
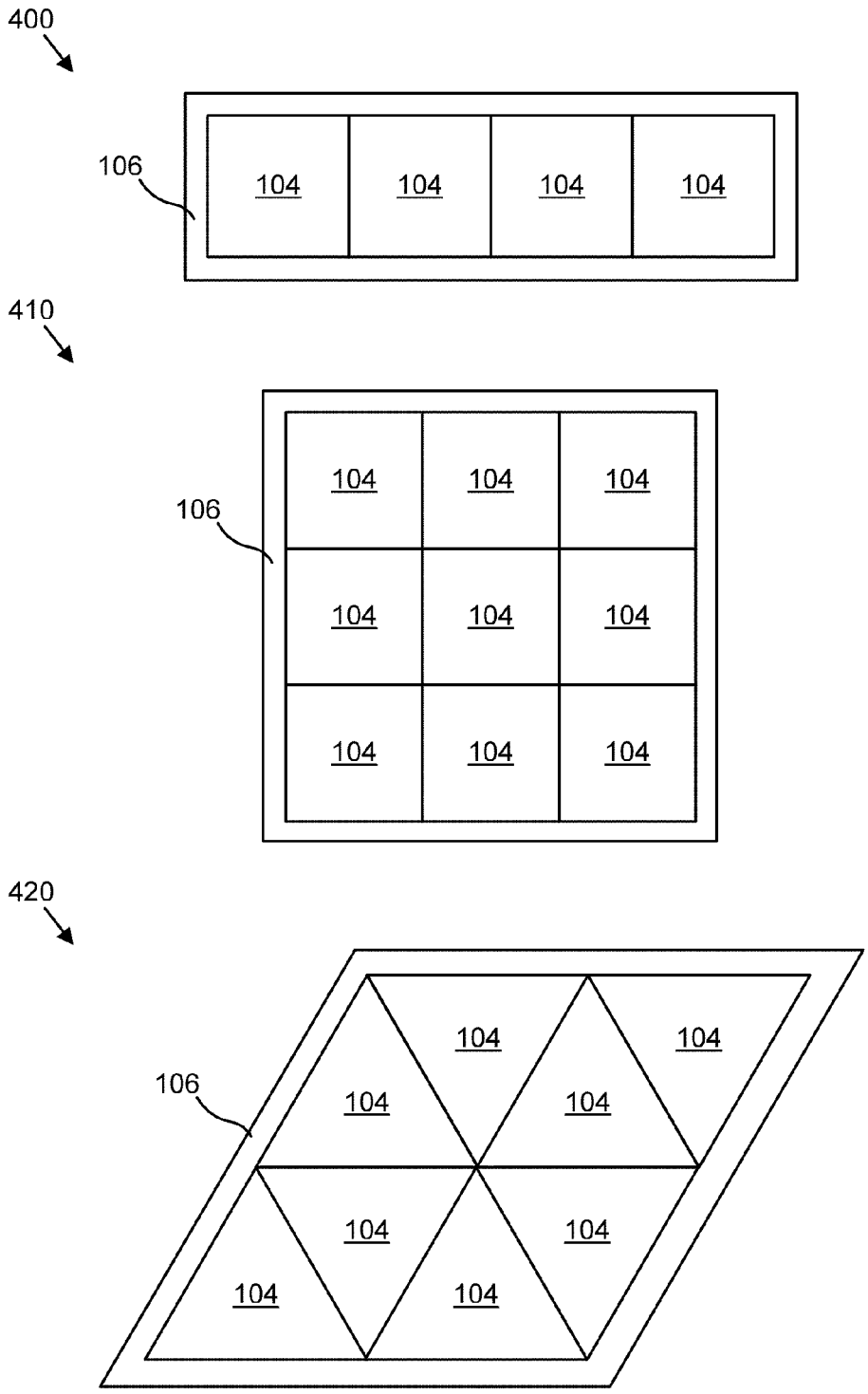
FIG. 4 is a schematic block diagram illustrating various embodiments of an integrated phased array tile system in accordance with the present invention.

FIG. 4 depicts various embodiments of integrated phased array tile systems 400, 410, 420. Various shapes are possible for array tiles 104. For a rectangular tile, attachment fixtures 206 may be located on one or more of the four sides of the tile 104, allowing the tiles 104 to be connected in a two dimensional grid pattern to form a large phased array, as illustrated in the first array tile system 400 and in the second array tile system 410. A hexagonal array, in certain embodiments, allows a reduced number of elements for a given aperture size as compared to a rectangular array 400, 410. The tile 104 shape required for a hexagonal array is nonrectangular, and includes the union of several equilateral triangles. The number of the equilateral triangles, in one embodiment, may be chosen so that the number of antenna elements 202 matches the number of RF ports on the beamformer chip 204. One possible tile shape for a hexagonal array is a parallelogram 420 with two rows of four elements 104 and one row of four elements 104 offset by half the element spacing. For array antenna applications using steering in one dimension, the tiles 104 can be designed to connect only on two sides, so they can be chained to form a linear (one dimensional) phased array 400.

For some applications, it may be desirable to minimize the total size and weight of a phased array 102. In this case, a shared-aperture tile 104 is needed. A shared aperture tile 104, in certain embodiments, includes both transmit and receive RF signal handling. Using a duplexer circuit, or the like, in one embodiment, the antenna elements 202 on the array 102 can be shared by the transmitter and receiver. In another embodiment, separate antenna elements 202 for the transmit and receive sides may be interleaved on the array 102.

In certain embodiments, one advantage of the array tile 104 approach may be that the electrical, thermal, and mechanical performance of the tile 104 can undergo test and evaluation before assembly of the full array 102. Array 102 phase and amplitude calibration can also be performed at this stage. The RF circuit board 204, in certain embodiments, may include adjustable phase delays to allow fine-scale correction of the relative antenna element 202 phases, to simplify calibration of the full array 102. An automated test fixture, in one embodiment, may be attached to the RF, DC, and/or digital control line connectors of the connection module 206. In a further embodiment, the connection module 206 includes a dedicated test connector for additional test points.

One example embodiment of the phased array tile system 102 is a Ku band satellite downlink phased array antenna 102. The largest segment of direct broadcast satellite and very small aperture terminal data services is Ku band (10-15 GHz). Services within this band use both linear and circular polarizations. Since linear polarization on a mobile platform requires electronic polarization control, but circular polarization does not, in certain embodiments, circular polarization may be easier to implement. The tile 104 design in this example embodiment may be a dual right and left hand circularly polarized Ku band receiving phased array tile 104 for the broadcasting satellite service ("BSS") and direct broadcast satellite ("DBS") markets. The band allocated to this service in the U.S. is 12.2 to 12.7 GHz. The array tile 104, in the example embodiment, may be designed for a "full-sky" field of view with nearly horizon-to-horizon beam steering range, or the like.

The array tile 104, in the example embodiment, may have 16 dual-polarized antenna elements in a 4×4 array and one RF beam output per polarization, or the like. In the example embodiment, the connection module 206 for the array tile 104 may include 16 right hand circular polarized antenna element feed ports and 16 left hand circular polarized antenna element feed ports, so the tile 104 is a 16×2 element array, where 16 is the number of dual-polarized elements with two feed ports each and the total number of feed ports is 32. The beamformer electronics 204, in the example embodiment, forms one steerable beam for right hand circular polarization and a second independently steerable beam for left hand circular polarization. The array tile 104, in the example embodiment, includes four blocks of four dual-polarized elements 202 each with one beamformer chip 204 per block, for a total of four beamformer chips 204. For each block of four elements 202, one of the four element beamformers on the chip 204 forms a right hand circular polarized beam, and the other four element beamformer 204 forms a left hand circular polarized beam.

The antenna elements 202, in the example embodiment, are low loss patch antennas 202 with two feed lines and a 180 degree hybrid to achieve two antenna ports, one that radiates right hand control ("RHC") polarization and the other that radiates left hand control ("LHC") polarization. Other realizations of a dual-polarization antenna element can also be used in other embodiments. The antenna element 202 shape and dimensions, in one embodiment, may be designed using antenna optimization procedures to realize a given antenna impedance at the antenna ports, or the like. Considered as a complete structure, in the example embodiment, the array element 202 and hybrid comprise a two-port antenna 202 with one port feeding LHC polarization and the other RHC polarization. For a full-sky array, in certain embodiments, the elements 202 may be one half wavelength in each linear dimension. The wavelength in the 12.2 to 12.7 GHz band is about 2.4 cm. The array grid spacing, or the offset between element 202 center points, in the example embodiment, is one half wavelength (2.4 cm). The 16 element array of a tile 104, in the example embodiment, is a square of side 9.6 cm.

The antenna ports of the antenna elements 202, in the example embodiment, feed a low noise amplifier ("LNA"), such as a transistor amplifier with associated bias control circuitry, or the like. The amplifier, in one embodiment, is designed using techniques to have a very low noise figure. The antenna 202, in the example embodiment, is active impedance matched to the amplifiers, so that the active impedances presented by the array 102 to the amplifiers as the beam is steered remain close to the optimal noise impedance expected by the LNAs. Active impedance matching, in one embodiment, may be accomplished using antenna software design optimization software, or the like. Precise values for the antenna 202 geometry, in certain embodiments, may be dictated by the active impedance matching condition. The noise figure of the beamformer chip 204, in the example embodiment, may be around about 4 dB, which means that the gain of the LNA may be around about 20 dB in order to limit the noise contribution of the beamformer chip to 4 K, or the like. To minimize noise due to electrical loss, in the example embodiment, the LNAs are located directly at the element 202 feed terminals on an RF printed circuit board 204. Traces on the printed circuit board 204 (PCB), in the example embodiment, feed the LNA outputs to the RF inputs of a beamformer chip 204.

The outputs of the beamformer chips 204, in the example embodiment, are added in two groups of four with two 4 to 1 power combiners implemented to form two beam outputs for the tile 104, one for each polarization. The combiners, in the example embodiment, may be implemented as passive components on the printed circuit board (PCB) 204. The power combiner and transmission line connections, in one embodiment, may be routed so that the phase length of each signal path is substantially identical. This ensures that when all phase shifters in the beamformer chips are commanded to the zero phase state, the beam formed by the tile 104 is steered to the broadside direction.

The tile external interface of the connection module 206, in the example embodiment, includes two RF outputs, two DC power supply inputs, signal and power grounds, digital control lines, and the like. Each beamformer chip 204, in the example embodiment, includes 12 digital control lines to control the phase and gain settings of the RF beamformer signal paths and two clock inputs, one for each of the two four input beamformers on the chip 204. To reduce the number of external connections, a serial to parallel converter, in certain embodiments, may be included on the PCB 204 to convert a single digital input line into the 12 digital control and clock signals, or the like. The DC, power ground, and digital lines, in one embodiment, may use a low-frequency connector. The RF outputs, in one embodiment, may be connected using two high frequency connectors to maintain signal integrity and minimize losses. Each RF output connector, in one embodiment, includes a signal ground shield.

An alternative embodiment includes one or more RF switches at each element 202 to switch between the RHC and LHC output ports, so that instead of dual polarization outputs, the array polarization is selectable between RHC and LHC polarization. One advantage of this embodiment is that the number of beamformer chips 204 required may be reduced from four to two. The polarization, in another embodiment, may be factory-selectable, or the like, and may be fixed in operational use.

A tile 104, in various embodiments, may be designed with a different number of antenna elements 202. To achieve a greater economy of scale, at the cost of reduced flexibility and possibly lower manufacturing yield, in certain embodiments, the number of elements 202 per tile 104 could be increased. The number of element ports, in various embodiments, may be evenly divisible by the number of inputs or outputs on the beamformer chips 204, to avoid unused beamformer channels. A power of two, in certain embodiments, may be advantageous because the power combiners can be designed for an even power of two inputs, but other numbers of elements 202 may also be accommodated. The array of elements 202 of a tile 104 also need not be square, so that the elements 202 can be arranged into a grid of M rows of elements and N columns, for a total of MN elements 202. A four element tile 104 is also possible, with one beamformer chip 204, or the like. One of skill in the art will recognize other design alternatives using the tile approach in light of this disclosure.

For some satellite broadcast services, the polarization of the transmitted fields may be linear. In order for the phased array 102 to achieve maximum signal quality when mounted on a mobile platform for in-motion applications, in certain embodiments, the array 102 may be polarization-agile and have the capability to track the transponder polarization adaptively. In a second example embodiment, the tile 104 operates in the 12.2 to 12.7 GHz BSS and DBS band.

For a polarization agile receive array tile 104, in the second example embodiment, the antenna elements 202 may be horizontal, broadband thickened crossed dipoles over low loss dielectric and ground plane, or the like. The dipole elements, in the second example embodiment, are nominally one half wavelength in length, for example at a design center frequency of 12.45 GHz, or the like. At this example frequency, the wavelength is 2.41 cm, which means that the length of each dipole is approximately 1.2 cm. The dipole elements 202, in the second example embodiment, are spaced one quarter wavelength above the ground plane, or 0.6 cm in the example. Each dipole 202, in the second example embodiment, comprises two metal arms with a feed transition to a waveguide support. The metal arms and waveguide support, in one embodiment, may be designed using antenna optimization procedures to realize a given antenna impedance at the waveguide output port, or the like. The waveguide, in one embodiment, includes a transmission line for a received signal and feeds a low noise amplifier (LNA) consisting of a low noise transistor amplifier with associated bias control circuitry. The antenna 202, in one embodiment, is active impedance matched to the amplifiers, so that the active impedances presented by the array 102 to the amplifiers as the beam is steered remain close to the optimal noise impedance expected by the LNAs. Active impedance matching, in one embodiment, may be accomplished using antenna software design optimization software. Precise values for the dipole arm shape, feed gap distance and height above ground plane, in certain embodiments, may be dictated by the active impedance matching condition, or the like.

The array tile 104, in the second example embodiment, has 32 antenna elements 202 in a 4×4 array and one RF beam output. The elements are crossed, in the second example embodiment, so that 16 are oriented in one direction and the other 16 are oriented in the orthogonal direction. By combining the outputs of pairs of crossed dipole elements with zero relative phase shift, in one embodiment, an arbitrary linear polarization can be synthesized.

The antenna ports, in the second example embodiment, feed a low noise amplifier ("LNA") consisting of a low noise transistor amplifier with associated bias control circuitry. To minimize noise due to electrical loss, in the second example embodiment, the LNAs are located directly at the element 202 feed terminals on an RF printed circuit board 204. Traces on the printed circuit board (PCB) 204, in the second example embodiment, feed the LNA outputs to the RF inputs of a beamformer chip 204.

For each group of four crossed dipoles 202, in the second example embodiment, the output ports of four dipoles 202 with a like orientation are fed after amplification by an LNA to four inputs of one half of a dual four channel beamformer chip 204. The output ports of the other four dipoles 202 with orthogonal orientation are fed to the other four inputs of the second half of the dual four channel beamformer chip 204. The PCB 204, in the second example embodiment, includes four total beamformer chips 204, each connected to a group of four crossed dipoles 202 in the same manner. The beam outputs for each beamformer block 204 are added with an 8 to 1 power combiner to form a single beam output for the tile 104.

The power combiner and transmission line connections, in the second example embodiment, are routed so that the phase length of each signal path is identical. This ensures that when all phase shifters in the beamformer chips are commanded to the zero phase state, in one embodiment, the beam formed by the tile 104 is steered to the broadside direction.

The tile external interface of the connection module 206, in the second example embodiment, comprises one RF output, two DC power supply inputs, signal and power grounds, digital control lines, and the like. Each beamformer chip 204, in the second example embodiment, receives 12 digital control lines to control the phase and gain settings of the RF beamformer signal paths and two clock inputs, one for each of the two four input beamformers on the chip 204. To reduce the number of external connections of the connection module 206, in one embodiment, a serial to parallel converter is included on the PCB 204 to convert a single digital input line into the 12 digital control and clock signals. or the like. The DC, power ground, and digital lines of the connection module 206, in one embodiment, use a low-frequency connector. The RF output of the connection module 206, in a further embodiment, is connected using a high frequency connector to maintain signal integrity and minimize losses and includes a signal ground shield.

One embodiment of the array tile 104 design described above includes an 8 to 1 power combiner. In another embodiment, the combiner may be replaced by analog to digital converters, so that after each group of four element 202 port outputs may be combined as analog signals, at the next level the beamforming is accomplished by the beamformer module 204 using digital signal processing. For a given bandwidth, in certain embodiments, digital processing may be more costly than analog, but may offer greater flexibility. Analog subtiles 104 with digital processing to combine tile 104 outputs, in one embodiment, may provide a compromise between cost and flexibility. One of skill in the art will recognize other alternatives using the tile approach in light of this disclosure.

Figure 5:
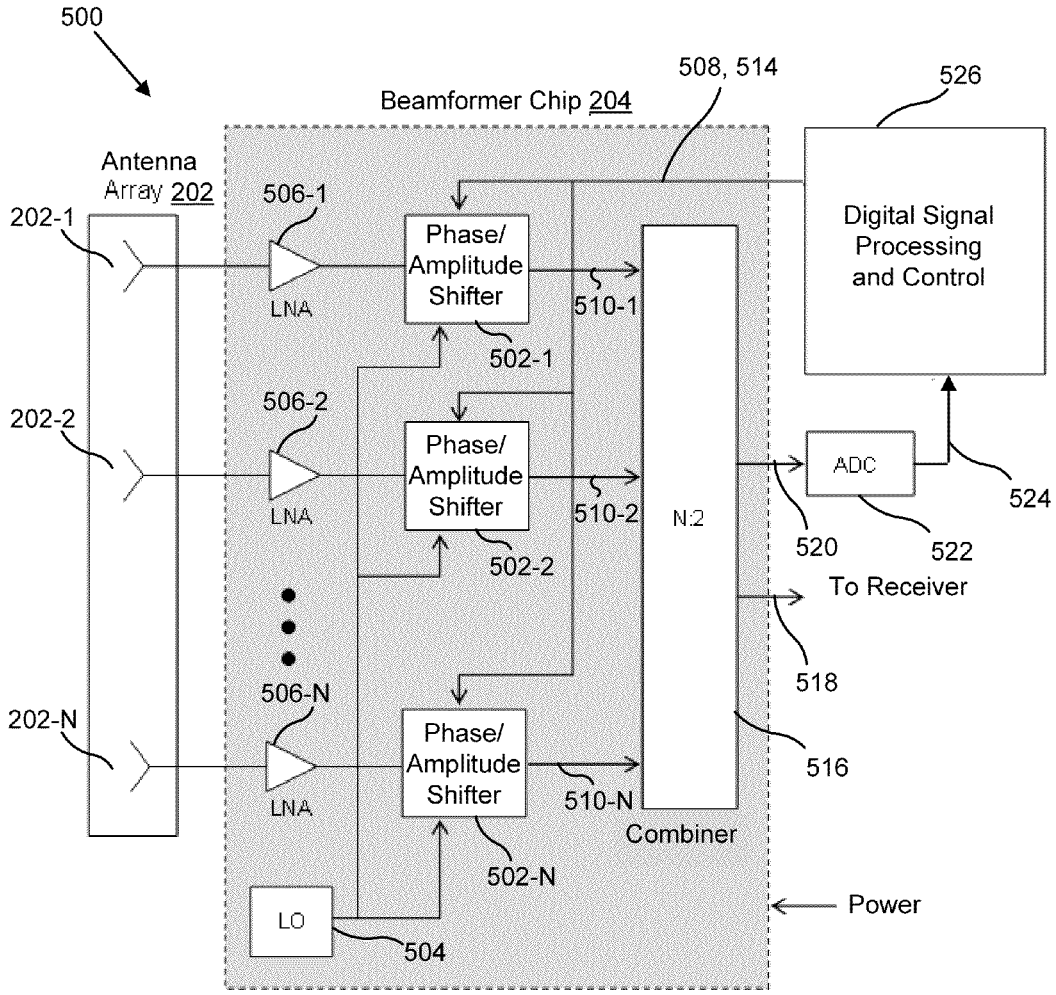
FIG. 5 is a schematic block diagram illustrating one embodiment of a phased array receiver in accordance with the present invention.

FIG. 5 depicts one embodiment of a phased array receiver tile 500. A two-phase oscillator 504 or the like, in one embodiment, drives a plurality of variable amplitude and phase shifters 502, which are controlled by a plurality of in-phase control voltages 508 and a plurality of quadrature control voltages 514, generating a plurality of IF signals 510 from a plurality of RF signals received by a plurality of antennas 202 and amplified by a plurality of low-noise amplifiers 506.

The plurality of IF signals 510, in the depicted embodiment, are combined in a combiner 516 to yield a combined IF signal 518 and a copy of the combined IF signal 520 to be fed back for control purposes. The combiner 516, in one embodiment, reinforces the desired signal by adding together the plurality of IF signals 510 when they have been brought into phase alignment and adjusted in amplitude by the plurality of variable amplitude and phase shifters 502. In one embodiment, the combiner 516 is an integrated chip, part of the beamformer chip 204, or the like. In another embodiment, the combiner 516 is made up of discrete elements. One of skill in the art will recognize how to implement the combiner 516 in light of this disclosure. Depending on the mixer conversion loss, in certain embodiments, additional gain may be used after the plurality of IF signals 510 are combined to increase the signal level.

In one embodiment, the receiver tile 500 includes means for generating the in-phase and quadrature voltage controls 508 and 514 for each phase and amplitude shifter 502. One such means, shown schematically in FIG. 5, employs a digital signal processing and control unit 526 to sense the beamformer output and generate the control voltages 508 and 514 using a closed-loop feedback process. An analog to digital converter 522, in the depicted embodiment, converts the copy of the combined IF signal 520 to a digital IF signal 524 which may be processed by a digital signal processor 526 to algorithmically determine and provide the plurality of in-phase control voltages 508 and the plurality of quadrature control voltages 514 to the plurality of variable amplitude and phase shifters 502.

One type of control algorithm that, in certain embodiments, may be implemented on the digital signal processing and control unit 526, makes use of the amplitude control beneficially offered by the phase and amplitude shifter 502. The digital signal processor and control unit 526 can periodically enter a training phase in which the phase and amplitudes of each array branch are rapidly adjusted in such a way that the digital signal processor 526 and control unit can track the desired signal and maximize the output signal to noise ratio ("SNR") for the signal of interest. One option for this training phase is the formation of sum and difference beams updated to maximize the desired signal level.

A second option for the control algorithm, in certain embodiments, includes dithering of branch amplitudes, where the amplitude control functions of the phase and amplitude shifters 502 are used to make small adjustments to the amplitudes of each RF signal path according to a pattern that allows the digital signal processing and control unit 526 to determine algorithmically how to update the in-phase control voltages 508 and quadrature control voltages 514 in such a way that the output SNR is maximized. The first of these options may include periodic signal dropouts during the training phase. This second approach may allow continuous signal delivery, since magnitude changes would be small enough that the combined output still achieved sufficient SNR for signal reception.

Other algorithms may also be implemented on the digital signal processing and control unit 526 to generate the in-phase and quadrature voltage controls 508 and 514, including non-adaptive beamforming using a stored lookup table of control voltages based on known or pre-determined locations of the desired signal sources, or the like. Generation of the in-phase and quadrature voltage controls 508 and 514 may also be accomplished by an analog circuit which would replace the ADC 524 and digital signal processing and control unit 526, or the like.

These approaches combine the bandwidth handling capability of analog beamforming with the flexibility of digital beamforming. Fully digital beamforming may require that each array branch output be digitized and sampled. With many array elements and a broadband signal, the required digital signal processor 526 may be very expensive. The depicted embodiment allows a similar functionality to be realized using only one sampled and processed bit stream.

The amplitude control provided by the phase/amplitude shifters 502 also enables beam shaping for sidelobe reduction to optimize the SNR performance of the array receiver. For direct broadcast satellite ("DBS") receivers, spillover noise reduction is critical to achieving optimal SNR, so beam shaping using amplitude control is particularly beneficial for this application.

In certain embodiments, the desired source can be tracked and identified using carrier-only information, since the digital processing does not necessarily need to decode modulated signal information. In such cases, to reduce the cost of the digital signal processor 526, a narrowband filter may be included before the analog to digital converter 522 to reduce the bit rate that must be processed. For frequency-reuse or multiband services, a tunable receiver may be needed before the analog to digital converter 522.

In one embodiment, the plurality of variable amplitude and phase shifters 502 and the combiner 516 are integrated onto a beamformer chip 204. In another embodiment, the two-phase local oscillator 500 may also be integrated onto the beamformer chip 204. In a further embodiment, the plurality of low noise amplifiers 506 may also be integrated onto the beamformer chip 204. To reduce the chip 204 pin count, in certain embodiments, a digital to analog converter (not shown) may be integrated onto the chip 204 to generate the plurality of in-phase control voltages 508 and plurality of quadrature control voltages 514 indirectly from a digital control signal generated by the digital signal processor 526. To scale up the size of the phased array receiver tile 500, a plurality of combined IF signals 510 provided by a plurality of identical chips 204 may be combined together off-chip via a second stage combiner (not shown).

Figure 6:
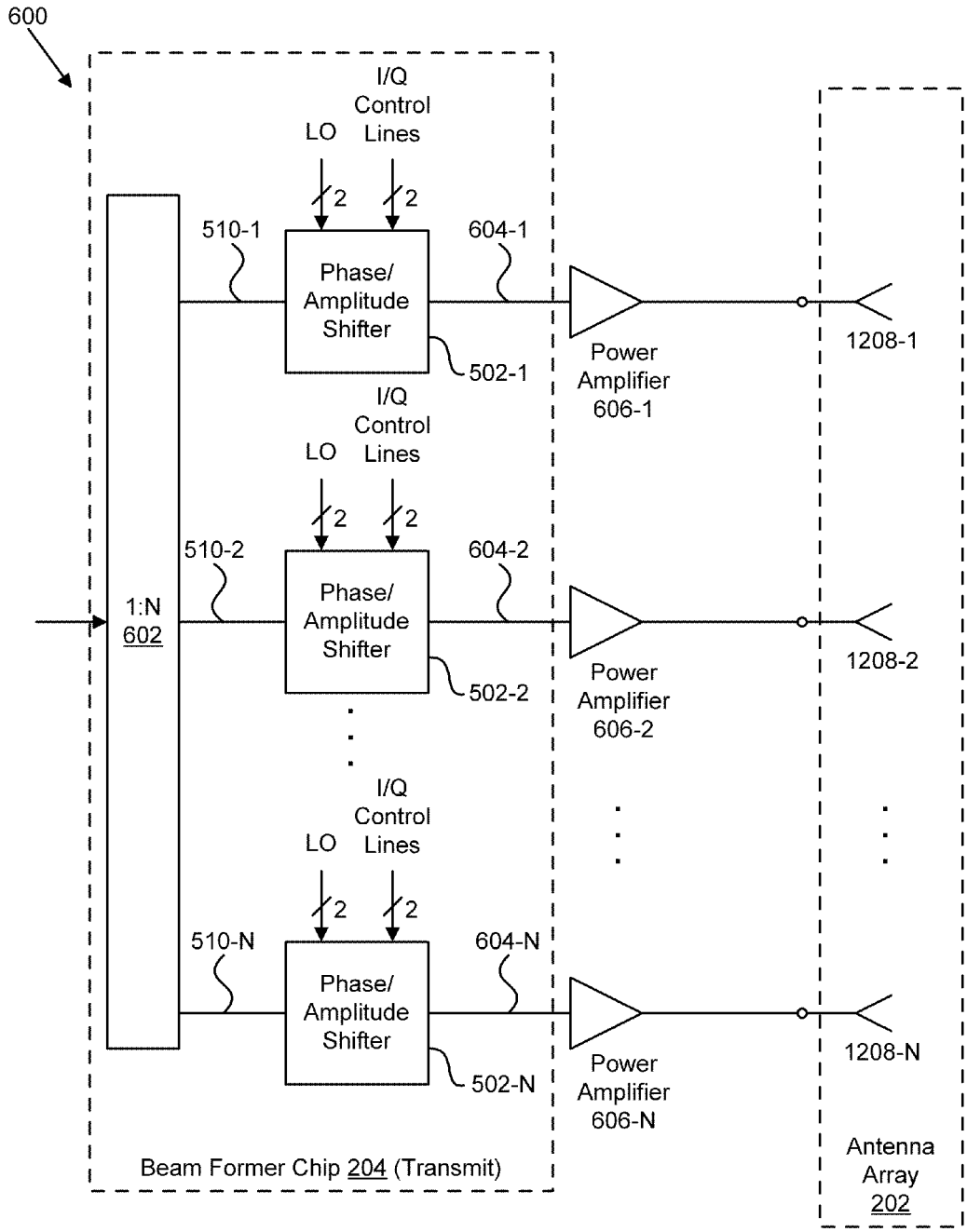
FIG. 6 is a schematic block diagram illustrating one embodiment of a phased array transmitter in accordance with the present invention.

FIG. 6 depicts one embodiment of a phased array transmitter 600. In certain embodiments, the plurality of variable amplitude and phase shifters 502 may be substantially similar to the variable amplitude and phase shifters 502 described above with regard to FIG. 5, but with a plurality of RF signals 604 and the plurality of IF signals 510 reversed. The plurality of IF signals 510, in the depicted embodiment, is generated by splitting a source IF signal 510 via a splitter 602. The phase and amplitude of the plurality of RF signals 604 are controlled in the same manner as before, except that frequency upconversion instead of downconversion is performed through appropriate filtering, and the plurality of RF signals 604 are amplified by a plurality of power amplifiers 606 to drive the plurality of antennas 202.

Figure 7:
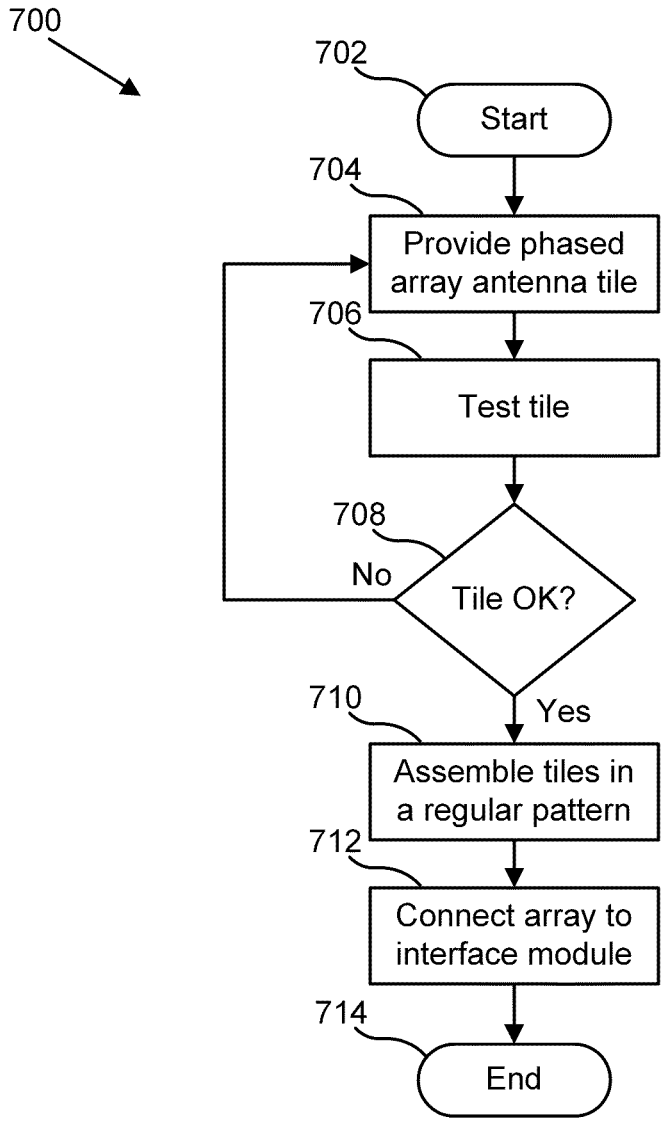
FIG. 7 is a schematic flow chart diagram illustrating one embodiment of a method for configuring a modular integrated phased array tile in accordance with the present invention.

FIG. 7 is a schematic flow chart diagram illustrating one embodiment of a modular integrated phased array tile configuration method 700. The method 700 begins 702 and a plurality of phased array antenna tiles 104 is provided 704. Each tile 104 may be tested 706 for proper functionality, quality, and so forth. If one or more tiles 104 fail testing 708 then other tiles 104 are provided 704. If the tiles 104 pass testing 708 then they may be assembled 710 into a regular pattern to form a phased array antenna of a predetermined type, size, and configuration from among a variety of predetermined types, sizes, and configurations. The interface module 106 may then be connected 712 to the assembled array, and the method 700 ends 714.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for phased array antenna communications, the apparatus comprising:

a phased array antenna tile comprising a plurality of antenna elements, each phased array antenna tile having a plurality of edges;

a beamformer module integrated into the phased array antenna tile, and comprising a plurality of phase shifters and one or more of a combiner and a splitter, the beamformer module electrically coupled to each antenna element to process directional signals for the plurality of antenna elements in the analog domain, wherein each phase shifter is configured to adjust a phase of a signal of and antenna element and wherein the combiner is configured to combine a signal from each of the plurality of antenna elements of the phased array antenna tile configured to receive a signal and wherein the splitter is configured to split a signal to provide a signal to each of the plurality of antenna elements of the phased array antenna tile configured to send a signal; and a plurality of cascadable connection points disposed along a perimeter of the phased array antenna tile for connecting the phased array antenna tile to one or more additional phased array antenna tiles, wherein the cascadable connection points provide structural support between the phased array antenna tile and the connected one or more additional phased array antenna tiles and maintain relative positioning between antenna elements on adjacent phased array antenna tiles, wherein the cascadable connection points comprise attachment fixtures that mechanically connect the phased array antenna tile to the one or more additional phased array antenna tiles along an edge of the phased array antenna tile, wherein the cascadable connection points provide structural support between the phased array antenna tile and the connected one or more additional phased array antenna tile independent of additional structure, wherein the cascadable connection points comprise a high-frequency connector along each edge of the phased array antenna tile that provides radio-frequency ("RF") inputs, RF outputs, and signal grounds, and a low-frequency connector along each edge of the phased array antenna tile that provides direct current ("DC") power supply connections, digital control lines, and power grounds.

2. The apparatus of claim 1, further comprising one or more low noise amplifiers integrated into the phased array antenna tile, wherein the phased array antenna tile comprises a receiver and the beamformer module is configured to receive the directional signals from a low noise amplifier of each of the plurality of antenna elements.

3. The apparatus of claim 2, wherein the one or more low noise amplifiers are one of disposed between the plurality of antenna elements and the beamformer module and integrated with the beamformer module.

4. The apparatus of claim 2, further comprising one or more control lines configured to adjust one or more of phase and gain of a signal of each antenna element of the plurality of antenna elements on the phased array antenna tile, the control lines adjusting phase of each phase shifter and gain of the low noise amplifier of an antenna element.

5. The apparatus of claim 1, further comprising one or more power amplifiers integrated into the phased array antenna tile, wherein the phased array antenna tile comprises a transmitter and the beamformer module is configured to provide the directional signals to the plurality of antenna elements through a power amplifier.

6. The apparatus of claim 5, wherein the one or more power amplifiers are one of disposed between the plurality of antenna elements and the beamformer module and integrated with the beamformer module.

7. The apparatus of claim 5, wherein the one or more power amplifiers are integrated with the beamformer module further comprising one or more control lines configured to adjust one or more of phase and gain of a signal of each antenna element of the plurality of antenna elements on the phased array antenna tile the control lines adjusting phase of each phase shifter and gain of the power amplifier of an antenna element.

8. The apparatus of claim 1 wherein the beamformer module comprises an integrated chip.

9. A system for phased array antenna communications, the system comprising:

a plurality of phased array antenna tiles juxtaposed in a regular pattern, each phased array antenna tile comprising a plurality of antenna elements, each phased array antenna tile having a plurality of edge;

a beamformer module integrated into each phased array antenna tile, and comprising a plurality of phase shifters and a combiner, each beamformer module electrically coupled to each antenna element of a corresponding phased array antenna tile to process directional signals for the plurality of antenna elements in the analog domain, wherein each phase shifter is configured to adjust a phase of a signal of an antenna element and wherein the combiner is configured to combine a signal from each of the plurality of antenna elements of the phased array antenna tile configured to receive a signal and wherein the splitter is configured to split a signal to provide a signal to each of the plurality of antenna elements of the phased array antenna tile configured to send a signal;

a plurality of cascadable connection points disposed along a perimeter of each phased array antenna tile, wherein the cascadable connection points provide structural support between the phased array antenna tile and the connected one or more additional phased array antenna tiles and maintain relative positioning between antenna elements on adjacent phased array antenna tiles, wherein a subset of connection points on one phased array antenna tile mate with a corresponding subset of connection points on one or more juxtaposing phased array antenna tiles, wherein the cascadable connection points comprise attachment fixtures that mechanically connect the phased array antenna tile to the one or more additional phased array antenna tiles along an edge of the phased array antenna tile, wherein the cascadable connection points provide structural support between the phased array antenna tile and the connected one or more additional phased array antenna tiles independent of additional structure, wherein the cascadable connection points comprise a high-frequency connector along each edge of the phased array antenna tile that provides radio-frequency ("RF") inputs, RF outputs, and signals grounds, and a low-frequency connector along each edge of the phased array antenna tile that provides direct current ("DC") power supply connections, digital control lines, and power grounds; and an interface module that connects to a subset of connection points not mated between juxtaposing phased array antenna tiles.

10. The system of claim 9, wherein the plurality of phased array antenna tiles comprises one or more of a receiver and a transmitter.

11. The system of claim 9, further comprising a beamformer control module configured to perform additional beamforming on phased array antenna tile outputs using digital signal processing and further comprising control lines from the beamformer control module to each phased array antenna tile, the beamformer control module configured to generate digital amplitude and phase control signals that are distributed to the phased array antenna tiles via the control lines.

12. The system of claim 9, further comprising one or more low noise amplifiers integrated into each phased array antenna tile, wherein the plurality of phased array antenna tiles comprises a receiver and the beamformer modules are configured to receive the directional signals from a low noise amplifier of each of the plurality of antenna elements.

13. The system of claim 9, further comprising one or more power amplifiers integrated into each phased array antenna tile, wherein the plurality of phased array antenna tiles comprises a transmitter and the beamformer modules are configured to provide the directional signals to each of the plurality of antenna elements through a power amplifier.

14. An apparatus for transmitting and receiving phased array antenna communications, the apparatus comprising:

a phased array antenna tile comprising a plurality of antenna elements, each phased array antenna tile having a plurality of edges;

a beamformer integrated into the phased array antenna tile, and comprising a plurality of phase shifters, a combiner and a splitter, the beamformer module electrically coupled to each antenna element to process directional signals for the plurality of antenna elements, in the analog domain wherein each phase shifter is configured to adjust a phase of a signal of an antenna element and wherein the combiner is configured to combine a signal from each of the plurality of antenna elements of the phased array antenna tile configured to receive a signal and wherein the splitter is configured to split a signal to provide a signal to each of the plurality of antenna elements of the phased array antenna tile configured to send a signal, wherein the beamformer module sends directional transmit signals to the plurality of antenna elements and receives directional receive signals from the plurality of antenna elements; and a plurality of cascadable connection points disposed along a perimeter of the phased array antenna tile for connecting the phased array antenna tile to one or more additional phased array antenna tiles, wherein the cascadable connection points provide structural support between the phased array antenna tile and the connected one or more additional phased array antenna tiles and maintain relative positioning between antenna elements on adjacent phased array antenna tiles, wherein the cascadable connection points comprise attachment fixtures that mechanically connect the phased array antenna tile to the one or more additional phased array antenna tiles along an edge of the phased array antenna tile, wherein the cascadable connection points provide structural support between the phased array antenna tile and the connected one or more additional phased array antenna tiles independent of additional structure, wherein the cascadable connection points comprise a high-frequency connector along each edge of the phased array antenna tile that provides radio-frequency ("RF") inputs, RF outputs, and signal grounds, and a low-frequency connector along each edge of the phased array antenna tile that provides direct current ("DC") power supply connections, digital control lines, and power grounds.

15. The apparatus of claim 14, further comprising one or more duplexer circuits electrically coupled to the plurality of antenna elements, the one or more duplexer circuits allowing each antenna element to both transmit and receive.

16. The apparatus of claim 14, wherein the plurality of antenna elements comprise one or more transmit antenna elements interleaved among one or more receive antenna elements.

* * * * *